US010135125B2

(12) United States Patent
Vilenskiy et al.

(10) Patent No.: US 10,135,125 B2
(45) Date of Patent: Nov. 20, 2018

(54) ULTRA-WIDEBAND (UWB) ANTENNA

(71) Applicant: Samsung Electronics Co., Ltd., Suwon-si (KR)

(72) Inventors: Artem Rudolfovich Vilenskiy, Moscow (RU); Andrey Vladimorovich Kletsov, Moscow (RU); Vladimir Yakovlevich Arkhipenkov, Mytishchi (RU); Dong Wook Kim, Seoul (KR); Jong Jin Kim, Hwaseong-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 129 days.

(21) Appl. No.: 14/097,742

(22) Filed: Dec. 5, 2013

(65) Prior Publication Data

US 2014/0152514 A1 Jun. 5, 2014

(30) Foreign Application Priority Data

Dec. 5, 2012 (RU) ..... 2012152251
Sep. 17, 2013 (KR) ..... 10-2013-0111730

(51) Int. Cl.
*H01Q 1/27* (2006.01)
*H01Q 9/04* (2006.01)
(Continued)

(52) U.S. Cl.
CPC ..... *H01Q 1/273* (2013.01); *H01Q 5/20* (2015.01); *H01Q 5/25* (2015.01); *H01Q 5/364* (2015.01); *H01Q 9/0421* (2013.01)

(58) Field of Classification Search
CPC ..... H01Q 1/273
(Continued)

(56) References Cited

U.S. PATENT DOCUMENTS 4,040,060 A * 8/1977 Kaloi ..... H01Q 9/0421 343/700 MS
6,680,705 B2 * 1/2004 Tan et al. ..... 343/702
(Continued)

FOREIGN PATENT DOCUMENTS

JP 2002-223114 A 8/2002
JP 2007-60615 A 3/2007
(Continued)

OTHER PUBLICATIONS

Chahat et al. (A Compact UWB Antenna for On-Body Applications, IEEE Transaction on Antenna and Propagation, vol. 59, No. 4, Apr. 2011).*

(Continued)

*Primary Examiner* — Daniel J Munoz
*Assistant Examiner* — Bamidele A Jegede
(74) *Attorney, Agent, or Firm* — NSIP Law

(57) ABSTRACT

A small-sized ultra-wideband (UWB) antenna includes a radiating unit configured to have a contour of a first shape, a ground unit configured to have a contour of a shape substantially equal to the first shape, and disposed parallel to the radiating unit, at least one shorting pin connected orthogonal to the ground unit and the radiating unit to connect a first area of the ground unit and a first area of the radiating unit, and a feeding unit connected orthogonal to the ground unit and the radiating unit to connect a second area of the ground unit and a second area of the radiating unit.

20 Claims, 2 Drawing Sheets

(51) Int. Cl.
*H01Q 5/20* (2015.01)
*H01Q 5/25* (2015.01)
*H01Q 5/364* (2015.01)

(58) Field of Classification Search
USPC ..... 343/718
See application file for complete search history.

(56) References Cited

U.S. PATENT DOCUMENTS 7,113,133 B2 * 9/2006 Chen et al. ..... 343/700 MS
7,271,774 B2 * 9/2007 Puuri ..... 343/718
7,315,285 B2 * 1/2008 Bancroft et al. ..... 343/702
7,808,433 B2 * 10/2010 Rutfors et al. ..... 343/700 MS
2002/0103441 A1 * 8/2002 Matsumura ..... A61B 5/0006 600/509
2002/0130816 A1 * 9/2002 Boyle ..... H01Q 1/243 343/702
2002/0135521 A1 * 9/2002 Moore ..... H01Q 1/243 343/702
2003/0020810 A1 * 1/2003 Takizawa ..... A61B 1/00105 348/68
2003/0076268 A1 * 4/2003 Tarvas ..... H01Q 1/243 343/702
2003/0174092 A1 * 9/2003 Sullivan ..... H01Q 1/243 343/702
2004/0104848 A1 * 6/2004 Desclos ..... H01Q 1/242 343/700 MS
2005/0024272 A1 * 2/2005 Ponce De Leon ..... H01Q 1/243 343/702
2006/0097921 A1 * 5/2006 Luk ..... H01Q 9/36 343/700 MS
2008/0180339 A1 * 7/2008 Yagi ..... H01Q 1/243 343/767
2009/0002248 A1 * 1/2009 Zhao ..... H01Q 1/243 343/722
2009/0058735 A1 * 3/2009 Hill ..... H01Q 1/243 343/702
2009/0262028 A1 * 10/2009 Mumbru ..... H01Q 5/371 343/702
2009/0278745 A1 * 11/2009 Huang ..... 343/700 MS
2010/0328182 A1 * 12/2010 Wong ..... H01Q 1/2266 343/848
2011/0156971 A1 * 6/2011 Yang et al. ..... 343/729

FOREIGN PATENT DOCUMENTS

JP 2007-181076 A 7/2007
JP 2010-98683 A 4/2010
KR 10-2007-0054989 A 5/2007
KR 10-2008-0019778 A 3/2008
KR 10-0820374 B1 4/2008
KR 10-2009-0008031 A 1/2009
KR 10-2009-0080712 A 7/2009

OTHER PUBLICATIONS

Hamalainen et al. (Wireless Medical Communication Using UWB, ICUWB Sep. 2009).*

* cited by examiner

ULTRA-WIDEBAND (UWB) ANTENNA

CROSS-REFERENCE TO RELATED APPLICATION(S)

This application claims the benefit under 35 USC § 119(a) of Russian Patent Application No. 2012152251, filed on Dec. 5, 2012, in the Russian Patent and Trademark Office, and Korean Patent Application No. 10-2013-0111730, filed on Sep. 17, 2013, in the Korean Intellectual Property Office, the entire disclosure of which is incorporated herein by reference for all purposes.

BACKGROUND

1. Field

The following description relates to telecommunications, including design and application of ultra-wideband (UWB) antennas, and more particularly, to a subclass of UWB antennas to be operated in proximity to or in contact with a human body or on a surface of the human body or other biological objects.

2. Description of Related Art

As it is known, tissues of a human body and most other biological objects possess a relatively high dielectric conductivity. Such high dielectric conductivity may cause a relatively high reflection coefficient of a wave falling from a free space and a relatively high attenuation coefficient of the wave transferred inside the tissues.

Under such circumstances an electromagnetic wave in proximity to a surface of a human body undergoes serious attenuation. However, under certain conditions, electromagnetic waves can be distributed around curvilinear objects. For effective transmission and reception of signals, communication devices and specially-designed antennas operating in a radio channel under wireless body area network (WBAN) standards are necessary. Such techniques are widely applied to such fields as medicine, sports, mobile communication, and other areas that have caused acceptance of standards (IEEE 802.15.6, http://standards.ieee.org/findstds/standard/802.15.6-2012.html).

Due to the IEEE 802.15.6 standards being widespread, creating new forms of wireless devices operating in an immediate proximity to a surface of a human body is possible. In general, such wireless devices have an independent power supply and a prominent limitation to power consumption. In such a situation, searching for methods to maximize a limitation to power consumption of each separate block of the devices is desirable.

Such methods to maximize the limitation to power consumption allow transmission and reception of electromagnetic signals in proximity to a surface of a human body, when receiving and transmitting antennas lack a line-of-sight, due to an effect of surface electromagnetic waves. Thus, miniaturization of devices, for example, remote health monitoring systems and peripheral devices in mobile communication systems has a considerable importance.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In accordance with an illustrative configuration, there is provided an antenna, including a ground conductive unit disposed near a surface of a human body, a radiating unit disposed at a distance from the ground conductive unit, a conductive shorting unit configured to connect the ground conductive unit and the radiating unit at predetermined points, and disposed orthogonal to the surface of the human body, and a conducting feeding unit configured to be connected to the ground conductive unit and the radiating unit at arbitrary points, and disposed substantially orthogonal to the surface of the human body. The ground conductive unit and the radiating unit may be oriented parallel to the surface of the human body, and at least one of the ground conductive unit and the radiating unit may include arbitrarily-shaped slits.

The radiating unit may include external dimensions substantially similar to external dimensions of the ground conductive unit.

The distance of the radiating unit from the ground conductive unit may be 0.2 to 0.5 of a medium wavelength in a bandwidth and in a direction approximately orthogonal to the surface of the human body.

The conductive shorting unit may be mounted on at least two samples.

The conductive feeding unit may be configured to have a gap in an arbitrary area with dimensions greater than 0.125 of a lower wavelength in the bandwidth.

The conducting feeding unit and the conductive shorting unit may be disposed to generate in-phase vertical currents in an operating frequency bandwidth.

External dimensions of the antenna may be determined based on a required operating frequency bandwidth calculated by Equation 1, $$lam/4=2*h+Lm, \quad \text{[Equation 1]}$$

lam is a lower operating wavelength in a bandwidth, h is a distance between the ground conductive unit and the radiating unit, and Lm is an average perimeter of a current contour on a surface of the slotted radiating unit. A value of the average perimeter may depend on a selected disposition of the arbitrarily-shaped slits.

In accordance with an illustrative configuration, there is provided a device, including an antenna ground conductive unit disposed in close proximity to the human body, and configured to have a surface of a geometrical shape substantially equal to a geometrical shape of an inner surface of the dielectric case of the device; an antenna radiating unit disposed at a distance from the antenna ground conductive unit; a conductive shorting unit configured to connect the antenna ground conductive unit and the antenna radiating unit at predetermined points, and disposed substantially orthogonal to the surface of the human body; and an antenna conducting feeding unit configured to be connected to the antenna ground conductive unit and the antenna radiating unit at arbitrary points, and disposed approximately orthogonal to the surface of the human body. At least one of the antenna ground conductive unit and the antenna radiating unit may include arbitrarily-shaped slits, and the antenna ground conductive unit and the antenna radiating unit are mounted on an internal surface of the device, and oriented maximally parallel to the surface of the human body.

The antenna radiating unit may include external dimensions substantially similar to external dimensions of the ground conductive unit.

The distance of the antenna radiating unit from the antenna ground conductive unit may be 0.2 to 0.5 of a medium wavelength in a bandwidth and in a direction approximately orthogonal to the surface of the human body.

The antenna conductive feeding unit may be configured to have a gap in an arbitrary area with dimensions greater than 0.125 of a lower wavelength in the bandwidth.

The antenna conducting feeding unit and the conductive shorting unit may be disposed to achieve an in-phase vertical currents distribution in an operating frequency bandwidth.

Dimensions of an external antenna may be determined based on a required operating frequency bandwidth calculated by Equation 1, $$lam/4=2*h+Lm, \quad \text{[Equation 1]}$$

lam is a lower operating wavelength in a bandwidth, h is a distance between the antenna ground conductive unit and the antenna radiating unit, and Lm is an average perimeter of a current contour on a surface of the slotted antenna radiating unit. A value of the average perimeter may depend on a selected disposition of the arbitrarily-shaped slits.

The device may be operated to be used in communication systems based on Institute of Electrical and Electronics Engineers (IEEE) 802.15.06 standards.

The device may be operated to organize radio communication between on-body terminals.

The device may be operated to organize radio communication between an on-body terminal and a remote external device.

In accordance with an illustrative configuration, there is provided an ultra-wideband (UWB) antenna including a radiating unit including a contour of a first shape; a ground unit including a contour of a shape substantially equal to the first shape, and disposed parallel to the radiating unit; a shorting pin connected orthogonal to the ground unit and the radiating unit to connect a first area of the ground unit and a first area of the radiating unit; and a feeding unit connected orthogonal to the ground unit and the radiating unit to connect a second area of the ground unit and a second area of the radiating unit.

The first shape forms a D-shape and includes a first boundary including a straight line, and a second boundary including a curve connected to both ends of the first boundary.

The radiating unit may include at least one slit.

The first shape forms a D-shape and includes a first boundary including a straight line, and a second boundary including a curve connected to both ends of the first boundary, and the at least one slit includes three slits, a first slit formed to be cut from the second boundary in a single direction, and a second slit and a third slit formed to be cut from the second boundary in a first direction and refracted and cut in a second direction.

When an electronic device including the antenna is in contact with a human body, the radiating unit and the ground unit may be disposed parallel to a human body.

The first area of the radiating unit may correspond to the first area of the ground unit.

The shorting pin may include two shorting pins.

The shorting pin may include a length of 0.2 to 0.5 of a medium wavelength in a bandwidth and the ground unit is disposed at a distance 0.2 to 0.5 of a lower wavelength in the bandwidth from the radiating unit.

The second area of the radiating unit may correspond to the second area of the ground unit.

The feeding unit may include a gap less than or equal to 0.125 of a lower wavelength in a bandwidth in an arbitrary area.

Dimensions of the antenna may be determined based on a required operating frequency bandwidth calculated by Equation 1, $$lam/4=2*h+Lm, \quad \text{[Equation 1]}$$

lam is a lower operating wavelength in a bandwidth, h is a distance between the ground unit and the radiating unit, and Lm is an average perimeter of a current contour on a surface of the slotted radiating unit. A value of the average perimeter may depend on a selected disposition of the slits.

In accordance with an illustrative configuration, there is provided an antenna, including a ground plate including a first boundary including a straight line extended in a direction of a single side, and a curved second boundary connected to both ends of the single side of the first boundary; a radiating plate configured to be disposed substantially parallel to the ground plate, at a distance from the ground plate in a direction orthogonal to a surface of a human body; a shorting pin configured to extend in a direction substantially orthogonal to the ground plate and the radiating plate and to connect the ground plate and the radiating plate; and a feeding pin configured to be connected at arbitrary points of the ground plate and the radiating plate. At least one of the ground plate and the radiating plate may include an arbitrarily-shaped slit.

The distance of the radiating plate from the ground plate may correspond to a length of the shorting pins from the ground plate.

The feeding pin may include a gap in an arbitrary area of which dimensions are not greater than 0.125 of a lower wavelength in the bandwidth.

The ground plate 1 and the radiating plate may be parallel to the surface of the human body, and the arbitrarily-shaped slit is formed to be cut from the second boundary of the radiating plate, in a curved shape, straight lines, or "L" shape.

The slit may be formed in a first direction from the second boundary of the radiating plate, and refracted and cut in a second direction.

Positions of the shorting pins may be adjustable to achieve in-phase vertical currents in an operating frequency bandwidth.

Other features and aspects will be apparent from the following detailed description, the drawings, and the claims.

BRIEF DESCRIPTION OF THE DRAWINGS

These and/or other aspects will become apparent and more readily appreciated from the following description of the embodiments, taken in conjunction with the accompanying drawings in which.

Figure 1:
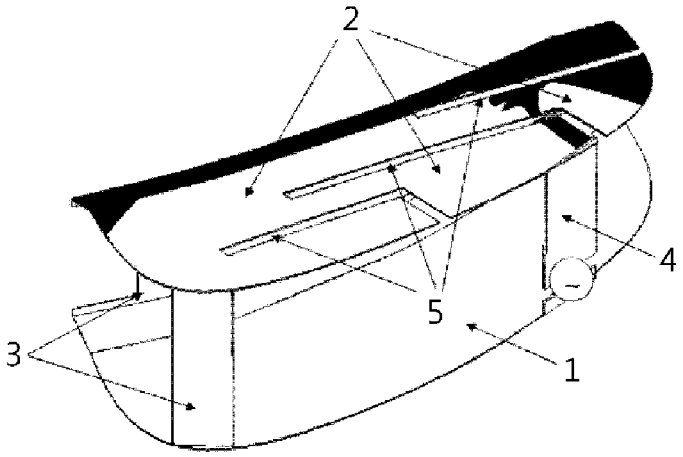
FIG. 1 is a perspective view illustrating an example of an antenna, in accord with an illustrative configuration.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. The progression of processing steps and/or operations described is an example; however, the sequence of and/or operations is not limited to that set forth herein and may be changed as is known in the art, with the exception of steps and/or operations necessarily occurring in a certain order. Also, description of well-known functions and constructions may be omitted for increased clarity and conciseness.

FIG. 1 is a perspective view illustrating an example of an antenna, in accord with an illustrative configuration. Referring to FIG. 1, the antenna includes a ground plate 1, a radiating plate 2, one or more shorting pins 3, a feeding pin 4, and a plurality of slits 5.

An overall shape of the antenna is illustrated in FIG. 1. The ground plate 1 and the radiating plate 2 are disposed to face each other. The ground plate 1 and the radiating plate 2 are disposed, for example, substantially parallel to each other.

In one example, the ground plate 1 is configured with a D-shape. The ground plate 1 includes a first boundary provided in a form of a straight line extended in a direction of a single side, and a second boundary provided in a form of a curve connected to both ends of the first boundary. Accordingly, the ground plate 1 may have a D-shaped contour including the first boundary and the second boundary. However, the D-shaped contour is provided simply as an example, and those skilled in the art may understand that the shape of the ground plate 1 may be changed.

In one configuration, the radiating plate 2 is disposed substantially parallel to the ground plate 1. The radiating plate 2 is disposed at a predetermined distance from the ground plate 1. In particular, the radiating plate 2 may be disposed at a distance corresponding to a length of the shorting pins 3 from the ground plate 1.

The radiating plate 2 is disposed at a distance, for example, 0.2 to 0.5 of a medium wavelength in a bandwidth, from the ground plate 1 in a direction orthogonal to a surface of a human body.

The radiating plate 2 has a contour substantially identical to a contour of the ground plate 1. Accordingly, external dimensions of the radiating plate 2 may be substantially identical to external dimensions of the ground plate 1. In one example, the radiating plate 2 may include a first boundary provided in a form of a straight line extended in a direction of a single side, and a second boundary provided in a form of a curve connected to both ends of the first boundary. Accordingly, the radiating plate 2 may have a D-shaped contour including the first boundary and the second boundary. However, the D-shaped contour is provided simply as an example, and those skilled in the art may understand that the shape of the radiating plate 2 is not limited thereto. The radiating plate 2 may have an alternative shape to be substantially identical to the contour of the ground plate 1.

The ground plate 1 may be designed to be disposed near a surface of a human body. In the alternative, the ground plate 1 may be configured to be disposed in contact with the surface of the human body.

The ground plate 1 and the radiating plate 2 are connected by one or more shorting pins 3. For purposes of brevity, one shorting pin 3 will be described. However, a person of ordinary skill in the relevant art will appreciate that multiple shoring pins 3 may be implemented in the configuration illustrated in FIG. 1. The shorting pin 3 extends in a direction substantially orthogonal to the ground plate 1. In addition, the shorting pin 3 extends in a direction substantially orthogonal to the radiating plate 2. In one configuration, the shorting pin 3 is implemented in a form of a pin, and in a form of pins of which a direction orthogonal to the ground plate 1 and the radiating plate 2 is relatively long.

According to an embodiment, two shorting pins 3 may be provided. However, the number of the shorting pins 3 is provided simply as an example, and those skilled in the art may understand that the number of the shorting pins 3 is not limited thereto. In addition, although it is described that each of the at least two shorting pins 3 is connected to the first boundary and the second boundary of the ground plate 1 or the radiating plate 2, portions of the ground plate 1 or the radiating plate 2 to which the shorting pins 3 are connected are not limited to such boundaries.

For example, the shorting pins 3, each may be mounted on at least two samples, configured to connect the ground plate 1 and the radiating plate 2 at predetermined points, and disposed substantially orthogonal to the surface of the human body. The feeding pin 4 may be connected to arbitrary points of the ground plate 1 and the radiating plate 2, and may have a gap in an arbitrary area of which dimensions are not greater than, for example, 0.125 of a lower wavelength in the bandwidth.

As illustrated in FIG. 1, the ground plate 1 and the radiating plate 2 are oriented to be parallel to the surface of the human body, and at least one of the ground plate 1 and the radiating plate 2 are profiled to include at least three arbitrarily-shaped slits. In one configuration, the slit refers to a long, narrow cut or opening.

The feeding pin 4 may be implemented in a form of a pin, similar to the shorting pins 3. The feeding pin 4 supplies currents, for example, to the radiating plate 2. The feeding pin 4 is connected orthogonal to the ground plate 1. In addition, the feeding pin 4 is connected orthogonal to the radiating plate 2. In one example, the feeding pin 4 is implemented in a form of a pin of which a direction orthogonal to the ground plate 1 and the radiating plate 2 is relatively long.

The feeding pin 4 may be connected to an external current supplier.

The radiating plate 2 receiving currents from the feeding pin 4 produces an electromagnetic wave.

The radiating plate 2 includes at least one slit. In one example, the slit refers to a cutout formed on the radiating plate 2. The slit may be formed to have a width less than a predetermined length.

For example, as shown in FIG. 1, the slit is formed to be cut from the second boundary of the radiating plate 2, in a curved shape or in straight lines or in an "L" shape. When cut in an "L" shape, one length of one of the lines forming the "L" shape may be shorter than, longer than, or equal to a length of the other of the lines forming the "L" shape. As an example, the slit is formed to be cut in a first direction from the second boundary of the radiating plate 2. As another example, the slit is formed to be cut in the first direction from the second boundary of the radiating plate 2, and refracted and cut in a second direction. A shape of the slit is not limited to the foregoing description; in particular, the shape is not limited to a shape in which the slit is formed to be cut from the second boundary of the radiating plate 2.

In addition, although it is described that the slit may refer to a cutout, slits may be formed from a process of manufacturing the radiating plate 2. For example, the radiating plate 2 may be manufactured to include a slit through a molding operation.

Because the radiating plate 2 includes a slit, the radiating plate 2 forms a set of current contours, and enables a multi-resonant operation of the antenna at a fixed position of a phase center, which causes small distortions at radiation of UWB radio pulses.

The feeding pin 4 and the shorting pins 3 may be disposed to generate in-phase vertical currents in an operating frequency bandwidth.

In accordance with an illustrative configuration, in the antenna of FIG. 1, the ground plate 1 is reduced in size to be equal or substantially equal to a size of the radiating plate 2, which allows for construction of, generally, a symmetrical body of a hand-held device including the antenna of FIG. 1, with a reduction of shielding properties of the ground plate 1, leading to an increase in an antenna bandwidth. Another illustrative feature of the antenna of FIG. 1, according to an embodiment, is implementation of the radiating plate 2 and placement of shorting elements in a form of the one or more shorting pins 3. An external contour of the radiating plate 2 may be identical to a contour of the ground plate 1, however, to provide UWB characteristics of matching and directivity, the radiating plate 2 may include at least three slits 5, forming a set of various current contours, and, consequently, enable a multi-resonant operation of the antenna at an approximately fixed position of a phase center that causes small distortions at radiation of UWB radio pulses.

In FIG. 1, the antenna design contains two shorting pins 3 and a single feeding pin 4 provided in a form of a pin. Positions of the shorting pins 3 are adjustable to achieve in-phase vertical currents in an operating frequency bandwidth, and, as a consequence, a high gain for vertical polarization, a presence of which is desirable for communication between devices. In one example, the antenna is designed to be used on an inner surface of a case of a mobile device. Thus, economical usage of a small volume of the mobile device is possible due to conformity and flexibility of the design being provided. In one configuration, the ground plate 1 is mounted in an area in which the device is mounted on a surface of the human body of which a single side is to be a contact side and power loss in biological tissues may be considerably reduced.

A UWB nature and mixed polarization of the antenna illustrated and described with respect to FIG. 1, weakens matching characteristics and directivity to be less sensitive to minor variations in structure, presence, and placement of components of an inner device of the mobile device, for example, chips or batteries, while simultaneously providing stable formation of on-body to on-body and on-body to off-body radio channels. The overall antenna dimensions may be determined based on a required frequency bandwidth and dimensions of a case of the device. As a whole, Equation 1 may be used.

$$lam/4=2*h+Lm, \quad \text{[Equation 1]}$$

In Equation 1, lam denotes a lower operating wavelength in a bandwidth, h denotes a distance between the ground plate 1 and the radiating plate 2, and Lm denotes an average perimeter of a current contour on a surface of the slotted radiating plate 2. In this example, a value of the average perimeter may depend on a selected disposition of the arbitrarily-shaped slits.

Figure 2:
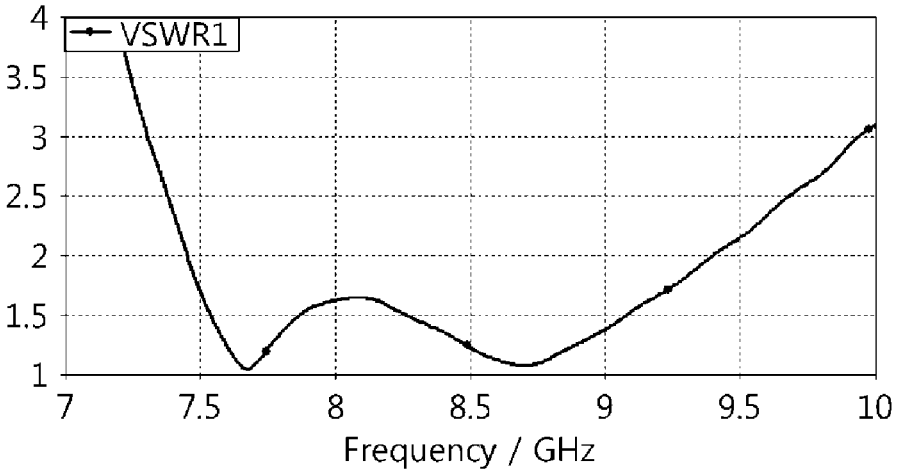
FIG. 2 is a graph illustrating a frequency dependence of a voltage standing wave ratio (VSWR) on an antenna input, in accord with an illustrative configuration.

An example of a measured standing-wave ratio (SWR) by antenna voltage, developed according to specified principles and inscribed inside a volume of 23×6×5.2 cubic millimeters ($mm^3$) is illustrated in FIG. 2.

The small-sized UWB antenna, according to an embodiment, may be mounted in mobile communication devices to be operated in an ultra-wide frequency band. In particular, the antenna may be successfully used to organize communication systems based on Institute of Electrical and Electronics Engineers (IEEE) 802.15.6 standards. In accord with an example, due to mixed polarization of radiation, it is possible to organize communication between on-body terminals, in which a presence of vertical polarization is necessary, and between on-body and external remote terminals.

FIG. 2 is a graph illustrating a frequency dependence of an SWR on an antenna input, in accord with an illustrative example. The graph of FIG. 2 considers principles of a class of devices, operating in a 7 to 10 gigahertz (GHz) band, in a case of a radiator disposed on a surface of a human head behind an auricle.

Construction of an antenna, according to an embodiment, may be based on common principles of generation of radiation of Planar Inverted F Antenna (PIFA) type typical antennas. Theoretical design concepts of such antennas may be found at www.antenna-theory.com/antennas/patches/pifa.php. In general, such antennas may include a conductive planar unit conditionally named "ground" (earth), and a radiating unit configured in a form of a strip or tape, which is placed over the ground and connected to the ground using a shorting element, for example, a shorting wall or shorting pin. Such antennas may also include a feeding element configured to connect the antenna to other elements of a super high frequency (SHF) path of the device. Conventional PIFA antennas are narrowband quasi-omnidirectional antennas with elliptic polarization. A given feature of directional diagrams of PIFA antennas enable an effective application of mobile communication devices in which concrete positioning of an object relative to a base station is not specified.

Another feature of the PIFA antennas is minimization of dimensions of the PIFA antennas while providing demanded matching in a specified lower frequency range. This effect is due to an appearance of a first resonance on an internal current contour of which dimensions appear approximately equal to a quarter of an operating wavelength. Under specified preconditions, common principles of PIFA type antennas may be implemented, and a previously unknown radiator possessing UWB characteristics may be manufactured for operation on a surface of a human body or other biological objects.

A small-sized UWB antenna, according to another embodiment, may include a ground conductive unit, a radiating unit, a conductive shorting unit, and a conducting feeding unit. In one illustrative example, the ground conductive unit, the radiating unit, the conductive shorting unit, and the conducting feeding unit may structurally correspond to the ground plate 1, the radiating plate 2, the shorting pin 3, and the feeding pin 4, respectively, illustrated in FIG. 1. The ground conductive unit may be disposed near a surface of a human body. The radiating unit, of which external dimensions are substantially similar to external dimensions of the ground conductive unit, may be disposed at a distance 0.2 to 0.5 of a medium wavelength in a bandwidth from the ground conductive unit, and in a direction approximately orthogonal to the surface of the human body. The conductive shorting unit may be mounted on at least two samples. The conductive shorting unit may be configured to connect the ground conductive unit and the radiating unit at predetermined points, and disposed orthogonal to the surface of the human body. The conducting feeding unit may be connected to the ground conductive unit and the radiating unit at arbitrary points, disposed substantially orthogonal to the surface of the human body, and configured to have a gap in an arbitrary area of which dimensions are less than or equal to 0.125 of a lower wavelength in the bandwidth. The ground conductive unit and the radiating unit may be oriented parallel to the surface of the human body, and at least one of the ground conductive unit and the radiating unit may be profiled by at least three arbitrarily-shaped slits.

In one configuration, the conducting feeding unit and the conductive shorting unit are disposed to generate in-phase vertical currents in an operating frequency bandwidth. External dimensions of the antenna may be determined based on a required operating frequency bandwidth calculated using Equation 1.

According to still another embodiment, a mobile communication device configured to execute an ultra-wideband (UWB) operating in close proximity to a human body is provided. The mobile communication device includes a dielectric case, and a small-sized UWB antenna disposed in the dielectric case. The mobile communication device includes an antenna ground conductive unit disposed in close proximity to the human body, and configured to have a surface of a geometrical shape equal to or substantially equal to a geometrical shape of an inner surface of the dielectric case of the mobile communication device. The mobile communication device also includes an antenna radiating unit, of which external dimensions are substantially similar to external dimensions of the antenna ground conductive unit, disposed at a distance 0.2 to 0.5 of a medium wavelength in a bandwidth from the antenna ground conductive unit in a direction approximately orthogonal to the surface of the human body. The mobile communication device further includes a conductive shorting unit mounted on at least two samples, configured to connect the antenna ground conductive unit and the antenna radiating unit at predetermined points, and disposed substantially orthogonal to the surface of the human body. The mobile communication device also includes an antenna conducting feeding unit connected to the antenna ground conductive unit and the antenna radiating unit at arbitrary points, disposed approximately orthogonal to the surface of the human body, and configured to have a gap in an arbitrary area of which dimensions are less than or equal to 0.125 of a lowest wavelength in the bandwidth.

In this example, at least one of the antenna ground conductive unit and the antenna radiating unit may be profiled by at least three arbitrarily-shaped slits. Further, the antenna ground conductive unit and the antenna radiating unit may be mounted on an internal surface of the dielectric case of the device, and oriented maximally parallel to the surface of the human body.

In addition, the antenna conducting feeding unit and the conductive shorting unit may be disposed to achieve an in-phase vertical currents distribution in an operating frequency bandwidth.

Dimensions of an external antenna may be determined based on a required operating frequency bandwidth calculated by Equation 1.

The device may be operated to be used in communication systems based on IEEE 802.15.06 standards.

The device may be operated to organize radio communication between on-body terminals.

The device may be operated to organize radio communication between an on-body terminal and a remote external device.

It will be understood that when an element or shorting pin 3 or other elements illustrated in FIG. 1 and correspondingly described is referred to as being "on" or "connected to" another element, sample, or layer, it can be directly on, operatively connected, or connected to the other element, sample, or layer or through intervening elements, samples, or layers may be present. In contrast, when an element is referred to as being "directly on" or "directly connected to" another element or layer, there are no intervening elements, samples, or layers present. Like reference numerals refer to like elements throughout.

It will be understood that, although the terms first, second, third, etc. may be used herein to describe various boundaries, elements, components, regions, layers and/or sections, these boundaries, elements, components, regions, layers and/or sections should not be limited by these terms. These terms are only used to distinguish one boundary, element, component, region, layer or section from another region, layer or section. These terms do not necessarily imply a specific order or arrangement of the elements, components, regions, layers and/or sections. Thus, a first boundary, element, component, region, layer or section discussed below could be termed a second boundary, element, component, region, layer or section without departing from the teachings description of the present invention.

The units described herein may be implemented using hardware components. For example, the hardware components may include conductors, radiators, feeders, controllers, and processing devices. For example, a processing device may be implemented using one or more general-purpose or special purpose computers, such as, for example, a processor, a controller and an arithmetic logic unit, a digital signal processor, a microcomputer, a field programmable array, a programmable logic unit, a microprocessor or any other device capable of responding to and executing instructions in a defined manner. The processing device may run an operating system (OS) and one or more software applications that run on the OS. The processing device also may access, store, manipulate, process, and create data in response to execution of the software. For purpose of simplicity, the description of a processing device is used as singular; however, one skilled in the art will appreciated that a processing device may include multiple processing elements and multiple types of processing elements. For example, a processing device may include multiple processors or a processor and a controller. In addition, different processing configurations are possible, such as parallel processors.

Software to perform functionalities described above may include a computer program, a piece of code, an instruction, or some combination thereof, for independently or collectively instructing or configuring the processing device to operate as desired. Software and data may be embodied permanently or temporarily in any type of machine, component, physical or virtual equipment, computer storage medium or device, or in a propagated signal wave capable of providing instructions or data to or being interpreted by the processing device. The software also may be distributed over network coupled computer systems so that the software is stored and executed in a distributed fashion. In particular, the software and data may be stored by one or more non-transitory computer readable recording mediums.

The non-transitory computer readable recording medium may include any data storage device that can store data which can be thereafter read by a computer system or processing device. Examples of the non-transitory computer readable recording medium include read-only memory (ROM), random-access memory (RAM), CD-ROMs, magnetic tapes, floppy disks, and optical data storage devices. Also, functional programs, codes, and code segments for accomplishing the example embodiments disclosed herein can be easily construed by programmers skilled in the art to which the embodiments pertain based on and using the flow diagrams and block diagrams of the figures and their corresponding descriptions as provided herein.

A number of examples have been described above. Nevertheless, it should be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An antenna, comprising:

a ground conductive unit, a radiating unit disposed to be spaced apart from the ground conductive unit, a conductive shorting unit configured to connect the ground conductive unit and the radiating unit at points, and configured to be disposed orthogonal to a surface of a human body, and a conducting feeding unit configured to be in physical contact with the ground conductive unit and the radiating unit at points, and configured to be disposed substantially orthogonal to the surface of the human body, wherein:

the ground conductive unit and the radiating unit are configured to be disposed parallel to the surface of the human body; and at least one of the ground conductive unit and the radiating unit comprise slits, wherein the conducting feeding unit and the conductive shorting unit are configured to generate in-phase vertical currents in an operating frequency bandwidth such that a high gain for vertical polarization is achieved, wherein the radiating unit forms a D-shape and comprises a first boundary comprising a straight line, and a second boundary comprising a curve connected to both ends of the first boundary, and wherein the slits of the radiating unit comprise a first slit cut from the second boundary in a single direction, and a second slit and a third slit cut from the second boundary in a first direction and refracted and cut in a second direction.

2. The antenna of claim 1, wherein the radiating unit comprises external dimensions substantially similar to external dimensions of the ground conductive unit.

3. The antenna of claim 1, wherein the distance of the radiating unit from the ground conductive unit is 0.2 to 0.5 of a medium wavelength in a bandwidth and in a direction approximately orthogonal to the surface of the human body.

4. The antenna of claim 3, wherein the conductive feeding unit is configured to have a gap having a length greater than 0.125 of a lower wavelength in the bandwidth.

5. The antenna of claim 1, wherein the conductive shorting unit is mounted on at least two samples.

6. The antenna of claim 1, wherein external dimensions of the antenna are based on a required operating frequency bandwidth calculated by Equation 1, $$lam/4=2*h+Lm, \quad \text{[Equation 1]}$$

wherein:

lam is a lower operating wavelength in a bandwidth, h is a distance between the ground conductive unit and the radiating unit, and Lm is an average perimeter of a current contour on a surface of the slotted radiating unit; and a value of the average perimeter depends on a selected disposition of the slits.

7. A device, comprising:

an antenna ground conductive unit having a surface of a geometrical shape substantially equal to a geometrical shape of an inner surface of a dielectric case of the device;

an antenna radiating unit disposed to be spaced apart from the antenna ground conductive unit;

a conductive shorting unit configured to connect the antenna ground conductive unit and the antenna radiating unit at points, and configured to be disposed substantially orthogonal to a surface of a human body; and an antenna conducting feeding unit configured to be in physical contact with the antenna ground conductive unit and the antenna radiating unit at points, and configured to be disposed approximately orthogonal to the surface of the human body, wherein:

at least one of the antenna ground conductive unit and the antenna radiating unit comprise slits; and the antenna ground conductive unit and the antenna radiating unit are mounted on an internal surface of the device, and configured to be oriented approximately parallel to the surface of the human body, wherein the antenna conducting feeding unit and the conductive shorting unit are disposed to generate an in-phase vertical currents distribution in an operating frequency bandwidth such that a high gain for vertical polarization is achieved, wherein the antenna radiating unit forms a D-shape and comprises a first boundary comprising a straight line, and a second boundary comprising a curve connected to both ends of the first boundary, and wherein the slits of the radiating unit comprise a first slit cut from the second boundary in a single direction, and a second slit and a third slit cut from the second boundary in a first direction and refracted and cut in a second direction.

8. The device of claim 7, wherein the antenna radiating unit comprises external dimensions substantially similar to external dimensions of the ground conductive unit.

9. The device of claim 7, wherein the distance of the antenna radiating unit from the antenna ground conductive unit is 0.2 to 0.5 of a medium wavelength in a bandwidth and in a direction approximately orthogonal to the surface of the human body.

10. The device of claim 9, wherein the antenna conductive feeding unit is configured to have a gap having a length greater than 0.125 of a lower wavelength in the bandwidth.

11. The device of claim 7, wherein dimensions of an external antenna are based on a required operating frequency bandwidth calculated by Equation 1, $$lam/4=2*h+Lm, \quad \text{[Equation 1]}$$

wherein:

lam is a lower operating wavelength in a bandwidth, h is a distance between the antenna ground conductive unit and the antenna radiating unit, and Lm is an average perimeter of a current contour on a surface of the slotted antenna radiating unit, wherein a value of the average perimeter depends on a selected disposition of the slits.

12. The device of claim 7, wherein the device is configured be used in communication systems based on Institute of Electrical and Electronics Engineers (IEEE) 802.15.06 standards.

13. The device of claim 7, wherein the device is operated to organize radio communication between on-body terminals.

14. The device of claim 7, wherein the device is configured to organize radio communication between an on-body terminal and a remote external device.

15. An ultra-wideband (UWB) antenna, comprising:

a radiating unit comprising a contour of a first shape;

a ground unit comprising a contour of a shape substantially equal to the first shape, and disposed parallel to the radiating unit;

at least one shorting pin connected orthogonally to the ground unit and the radiating unit to connect a first area of the ground unit and a first area of the radiating unit; and a feeding unit physically and orthogonally in contact with both the ground unit and the radiating unit to connect a second area of the ground unit and a second area of the radiating unit, wherein the feeding unit and the shorting pin are configured to generate in-phase vertical currents in an operating frequency bandwidth such that a high gain for vertical polarization is achieved, wherein the first shape forms a D-shape and comprises a first boundary comprising a straight line, and a second boundary comprising a curve connected to both ends of the first boundary, and wherein the radiating unit comprises three slits, a first slit cut from the second boundary in a single direction, and a second slit and a third slit cut from the second boundary in a first direction and refracted and cut in a second direction.

16. The antenna of claim 15, wherein the radiating unit and the ground unit are configured to be disposed parallel to the human body.

17. The antenna of claim 15, wherein the first area of the radiating unit corresponds to the first area of the ground unit.

18. The antenna of claim 15, wherein the at least one shorting pin comprises two shorting pins.

19. The antenna of claim 15, wherein each of the at least one shorting pins comprises a length of 0.2 to 0.5 of a medium wavelength in a bandwidth and the ground unit is disposed at a distance 0.2 to 0.5 of a lower wavelength in the bandwidth from the radiating unit.

20. An antenna, comprising:

a ground plate comprising a first boundary comprising a straight line extended in a direction of a single side, and a curved second boundary connected to both ends of the single side of the first boundary;

a radiating plate configured to be disposed substantially parallel to the ground plate, to be separate from the ground plate in a direction orthogonal to a surface of a human body;

a shorting pin configured to extend in a direction substantially orthogonal to the ground plate and the radiating plate and to connect the ground plate and the radiating plate; and a feeding pin configured to be in physical contact with points of the ground plate and the radiating plate, wherein at least one of the ground plate and the radiating plate comprise at least one arbitrarily-shaped slit, wherein the feeding pin and the shorting pin are configured to generate in-phase vertical currents in an operating frequency bandwidth such that a high gain for vertical polarization is achieved, wherein the radiating plate forms a D-shape and comprises a third boundary comprising a straight line, and a fourth boundary comprising a curve connected to both ends of the third boundary, and wherein the at least one arbitrarily-shaped slit of the radiating plate comprises a first slit cut from the second boundary in a single direction, and a second slit and a third slit cut from the second boundary in a first direction and refracted and cut in a second direction.

* * * * *